United States Patent [19]

Malcolm

[11] 3,938,557

[45] Feb. 17, 1976

[54] LIQUID FLUIDIC DEVICE

[75] Inventor: J. Douglas Malcolm, St. John's, Canada

[73] Assignee: Canadian Patents and Development Limited, Ottawa, Canada

[22] Filed: Mar. 20, 1975

[21] Appl. No.: 560,243

[52] U.S. Cl. ..... 137/834; 137/836; 137/837; 137/841; 137/842

[51] Int. Cl.[2] ..... F15G 1/14

[58] Field of Search ..... 137/834, 836, 837, 841, 137/842, 806

[56] References Cited

UNITED STATES PATENTS

| | | | |
|---|---|---|---|
| 3,234,955 | 2/1966 | Auger | 137/842 |
| 3,426,781 | 2/1969 | Neuman | 137/842 X |
| 3,455,317 | 7/1969 | Smith | 137/823 X |
| 3,874,416 | 4/1975 | Friedman | 137/842 X |

*Primary Examiner*—William R. Cline
*Attorney, Agent, or Firm*—Ronald G. Bitner

[57] ABSTRACT

A fluidic device using a free jet in which a control nozzle or nozzles terminate within the emitter jet, is disclosed. Positioning the ends of the control nozzles within the emitter jet avoids jet distortion when acted upon by control fluid for deflection. In the preferred embodiment, geometric symmetry is provided, either with control nozzles in pairs disposed opposite to each other, or another control member, such as a rod, disposed opposite to each control nozzle. A receiver for preventing air or gas entrainment is also disclosed. The device provides high efficiency, low noise, and operates with low pressure.

14 Claims, 6 Drawing Figures

LIQUID FLUIDIC DEVICE

BACKGROUND OF THE INVENTION

This invention relates to a fluidic device which utilizes a liquid jet in gaseous surroundings, herein referred to as a free jet.

Conventional fluidic devices generally utilize a submerged jet, whereby the jet fluid is identical to the fluid surrounding the jet stream. The submerged jet entrains fluid from the surroundings as it passes from the emitter nozzle to one or more receiver passageways, thus reducing the energy recovered in the receiver passageways. Fluidic devices of this kind require a substantial pressure head of fluid and are inherently of very low efficiency. When the jet stream is turbulent, a further performance limitation associated with the high turbulent noise levels in the received flows is noted.

A free jet, for example, a liquid jet operating in air, has the potential to eliminate many of the disadvantages of the submerged jet. However, to date, the potential of the free jet has not been realized because of the tendency of the jet to break up or distort when a control jet interacts with it.

In processes involving liquids, it would be advantageous to be able to use the process fluid itself to perform the control function in order to avoid mechanical - fluidic interfacing, as is presently required.

SUMMARY OF THE INVENTION

The deflection of a free jet differs considerably from that of a submerged jet. When a free jet flows from a nozzle into air or other gaseous surroundings, a substantially constant diameter jet is produced. The free jet is confined by the liquid - gas interface by means of surface tension. Because surface tension effects dominate over viscous effects, Weber number, rather than Reynolds number, has been found to provide a suitable scaling criteria.

It is an object of the present invention to provide a fluidic device which provides high efficiency, low received noise levels, and operates under low pressure head.

Another object is to provide a fluidic device utilizing a free liquid jet controlled by liquid signals.

Another object of the present invention is to provide means for deflecting a free liquid jet that preserves a coherent substantially uniform jet downstream from the region where deflection of the jet is effected.

It is a further object of the present invention to provide means for receiving a liquid jet which provides higher pressure recovery with higher flow recovery.

The above objectives are met by a fluidic device comprising; an emitter nozzle operative to issue a liquid emitter jet having a Weber number of from 8 to 70, control means comprising a control nozzle that terminates within the emitter jet and disposed a distance of less than five jet diameters downstream from the emitter nozzle and being operative to issue a control jet for deflecting the emitter jet, and receiver means spaced downstream from the emitter for receiving the emitter jet.

In a preferred embodiment of the invention, the control means includes a control member disposed diametrically opposite the control nozzle. This control member may be in the form of a second control nozzle or a solid rod. The device may also include additional control nozzles and control members.

Also, in a preferred embodiment of the invention, the receiver means comprises an orifice plate disposed substantially perpendicular to the emitter jet and has one or two receiver passageways extending downstream therefrom.

DESCRIPTION OF THE PREFERRED EMBODIMENTS

Figure 2:
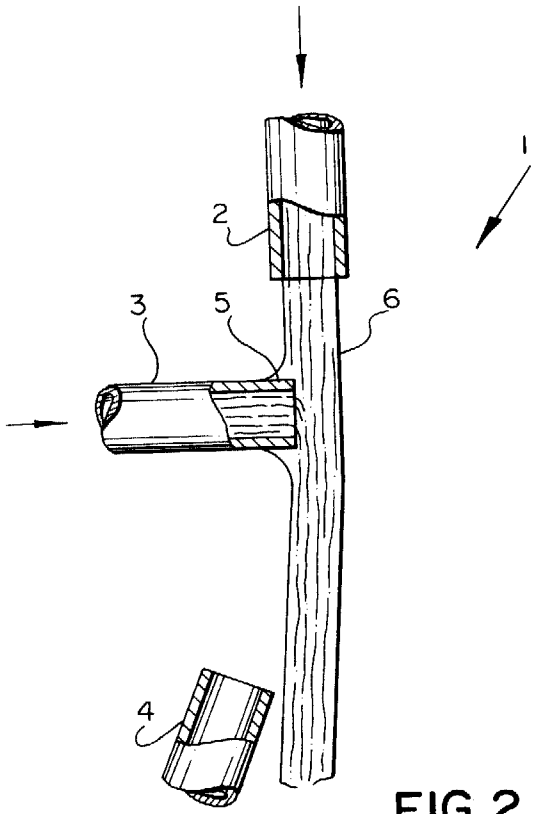
FIG. 2 shows the device of FIG. 1 with a control liquid supplied to the control nozzle.
Figure 1:
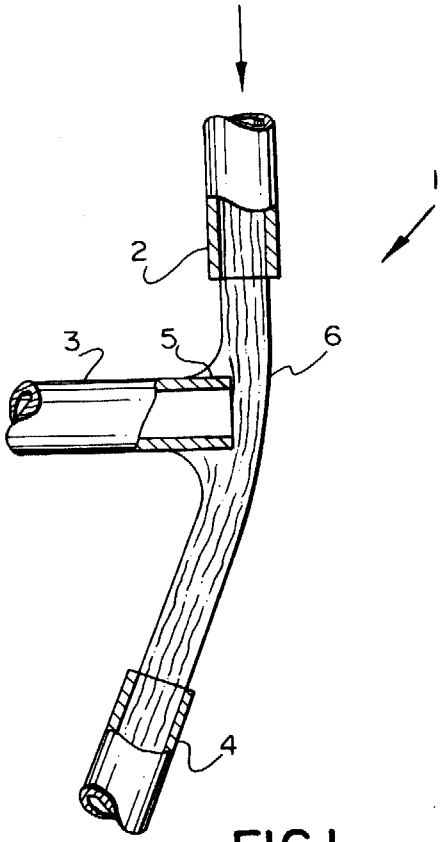
FIG. 1 is a generalized schematic representation of a liquid fluidic device according to the present invention, illustrating the positioning of the control nozzle and its effect on the emitter jet without the supply of a control liquid.

With reference to FIGS. 1 and 2, the basic fluidic device 1 comprises an emitter nozzle 2, a control nozzle 3 and a receiver 4. In operation, a liquid is supplied to the emitter nozzle such that it issues a free jet 6 having a Weber number of from 8 to 70. The control nozzle 3 is disposed such that one end 5 partially obstructs, or terminates within, the emitter jet 6 which causes the emitter jet to be deflected as is shown in FIG. 1. As shown in FIG. 1, maximum emitter jet flow is received by receiver 4 when no control flow is supplied to the control nozzle 3. With control flow to nozzle 3, the deflection of emitter jet 6 is reduced and less fluid is received by receiver 4. In FIG. 2, sufficient control fluid is supplied to control nozzle 3 so that no flow is received by receiver 4.

The positioning of the control nozzles as described, that is, terminating within the emitter jet, prevents emitter jet breakup, turbulence or distortion when interacted upon by control fluid.

As previously indicated, proper operation of the present device requires emitter jet flow with a Weber number of from 8 to 70. Below a Weber number of 8, breakup of the emitter jet 6 is probable, whereby the stream leaving the emitter nozzle 2 becomes unstable, and forms a stream of droplets before reaching the receiver 4. Above 70, emitter jet 6 may possess a disintegrating interface between the liquid and surrounding gas, and spray results which reduces the amount of received flow. It should be noted that a Weber number of 70 is beyond the laminar flow range.

Preferably, the emitter nozzle will have a length ten times the diameter, but no less than 5 times, this nozzle portion being substantially uniform in diameter, or slightly convergent. Such a nozzle provides that emitter jet flow is partially developed, or has a nonuniform velocity profile as it leaves the emitter nozzle 2 and intercepts the control nozzle.

The embodiment of FIGS. 1 and 2, having only one control nozzle, is not symmetrical and therefore, variations in emitter flow will cause changes in the received output. In most applications, this will be a disadvantage. In the following embodiments, sensitivity to emitter flow variations is avoided by the symmetrical arrangement of control elements.

Figure 3:
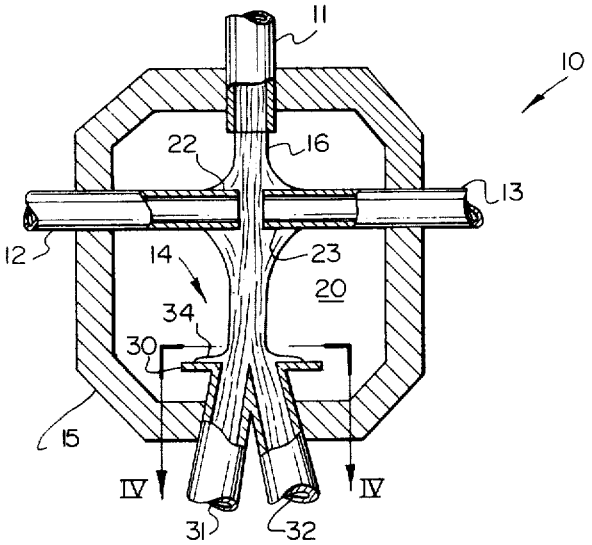
FIG. 3 is a partly sectional elevation of a proportional fluidic amplifier in accordance with the present invention.

FIG. 3 illustrates a fluidic proportional amplifier 10 which comprises an emitter nozzle 11, two control nozzles 12 and 13, receiver 14 and suitable supporting structure 15. As in the embodiment of FIGS. 1 and 2, the control nozzles 12 and 13 terminate within the emitter jet 16 so that the action of control flows through the nozzles serves only to deflect the jet stream 17 and not to cause jet breakup, turbulence or distortion. The deflection of jet 17 by control flows through nozzles 12 and 13 is controlled by the differential flow rate in these two said control nozzles.

The control nozzles should be disposed as near as possible to the emitter nozzle, where the emitter jet is still partially developed, that is, before it reverts to a uniform velocity profile. Preferably, the control nozzle will be less than five emitter jet diameters downstream from the emitter nozzle, measured to the control nozzle centerline.

Minimum distortion and maximum gain are obtained with the distance from the end of the control nozzle to the emitter jet centerline being from 0.1 to 0.2 times the emitter jet diameter.

Preferably, the control nozzles are circular in cross-section and have a diameter equal to the emitter nozzle. Further, it is desirable that the control nozzles 12 and 13 have a uniform smooth cylindrical outer surface with a free length of at least two diameters to allow uniform and unobstructed wetting of the outer surfaces 22 and 23.

While the control nozzles 12 and 13 are shown to be at right angles to the emitter nozzle 11, this angular relationship is not necessary. It is necessary, however, that the control nozzles be substantially horizontal, or aligned such that liquid flow does not occur along the nozzle surfaces away from their wetted ends.

The interaction region 20 should be vented or open to a gaseous atmosphere, normally air, so as not to impede the normal flow of gaseous atmosphere therethrough. Also, the supporting structure 15 should not impede emitter jet flow or restrict the formation of wetted surfaces of the control nozzles and the receiver 14.

Figure 4:
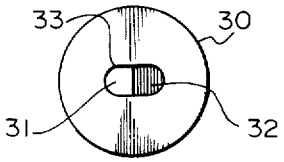
FIG. 4 is a plan view of the receiver shown in FIG. 3 taken along the lines denoted by IV—IV.

Referring to FIGS. 3 and 4, receiver 14 comprises orifice plate 30 and receiver passageways 31 and 32. Passageways 31 and 32 which are adjacent to each other, extend downstream from the orifice plate 30.

The orifice plate 30, as can be best seen in FIG. 4, has an orifice 33 that is elongated in the plane of the control nozzles 12 and 13. The orifice 33 defines the entrance to the passageways 31 and 32 and preferably has a major dimension of not greater than two emitter nozzle diameters and a minor dimension of not greater than the emitter nozzle diameter.

The orifice plate 30 comprises a substantially flat surface that surrounds the entrances to passageways 31 and 32 so as to provide for the formation of a pool of liquid 34 of sufficient diameter to prevent the intrusion of gas into the receiver passageways 31 and 32.

The receiver described above requires vertical orientation since the pool of liquid is maintained only if the orifice plate is substantially horizontal.

An alternative receiver, not requiring vertical orientation, comprises a receiver passageway that has sufficiently high impedance to exclude gas therefrom.

The output of proportional amplifier 10 is a pressure and flow differential in the receiver passageways proportional to the difference in fluid pressures in control nozzles 12 and 13. In operation, a pressurized fluid with a Weber number between 8 and 70 is supplied to emitter jet 11 to form a free jet stream 16. Control fluid, supplied to control passageways 12 and 13, acts on the free jet 16 to deflect it proportionally to the difference in pressure in the control nozzles. If the pressures are equal, the stream will not be deflected and most of the fluid stream 16 will enter receiver 14 with a substantially equal percentage of fluid entering passageways 31 and 32, thereby providing a zero pressure differential output. If, for example, the pressure in control nozzle 12 is greater than that in control nozzle 13, the jet 16 would be deflected so that a greater proportion of the fluid stream would exit through receiver passageway 32 than through receiver passage 31.

The gain of the proportional amplifier can be changed by changing the length from the emitter nozzle to the receiver. Generally, the longer this distance, the higher the gain. It is generally desirable, however, that this distance be no longer than 50 nozzle diameters, as the free jet stream 16 becomes marginally stable at greater length. Also, signal transport delay associated with the length of time required for a control differential signal to be transported to the receiver, will increase with increased length from emitter to receiver. A compromise between high gain and good dynamic performance has been found to require that the distance from the emitter nozzle exit to the receiver orifice plate be within the range of five to 20 nozzle diameters.

Preferably, the receiver passageways 31 and 32 have circular cross-sections with an entrance portion at orifice plate 30 having a diameter no greater than that of emitter nozzle 11. It is preferable that passageways 31 and 32 have either a uniform, or slightly divergent cross-section so as to provide diffusion of received flow and minimum impedance.

Means may be provided for catching and containing liquid which does not enter receiver passageways or which spills from the receiver orifice plate.

Figure 5:
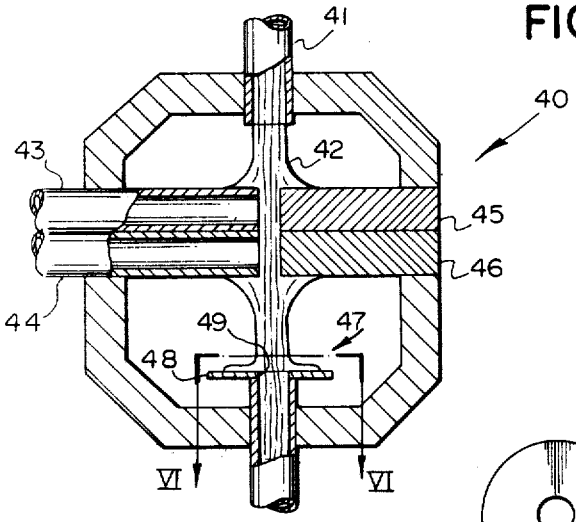
FIG. 5 is a partly sectional elevation of a fluidic NOR gate in accordance with the present invention.
Figure 6:
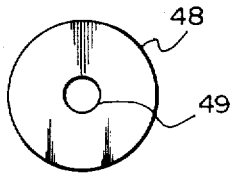
FIG. 6 is a plan view of the receiver shown in FIG. 5 taken along the lines denoted by VI—VI.

FIG. 5 illustrates an embodiment of the invention suitable as a NOR logic element. As in the previous embodiments, the fluidic device 40 comprises an emitter nozzle 41 which emits an emitter jet 42 having a Weber number between 8 and 70. Two control nozzles 43 and 44 are mounted on one side, and terminate within the emitter jet 42. Symmetrically opposite to the control nozzles 43 and 44 are two additional control members 45 and 46 without passageways. The control members 45 and 46 have outer wetted surfaces geometrically similar to that of the control nozzles 43 and 44 but do not have passageways for emitting fluid.

Receiver 47 is substantially coaxially aligned with free jet stream 42. Orifice plate 48 defines the entrance to the receiver, having an outer diameter at least twice the diameter of the orifice 49. Preferably, the orifice diameter is no greater than the emitter nozzle diameter. As in the embodiment of FIGS. 3 and 4, orifice plate 48 provides for a puddle formation above the entrance to the receiver 47 to prevent gas entrainment.

In operation, the digital amplifier shown in FIG. 5 acts as an active two input NOR gate. In the absence of control flows through either control nozzle 43 or 44, the emitter jet stream 42 will be undeflected and a substantial portion of the jet will be received by receiver 47. The presence of a control flow in either, or both, control nozzles will deflect the jet such that less fluid will be received by the receiver.

If desired, additional inputs can be provided for the NOR gate shown in FIG. 5, by providing additional control nozzles together with symmetrically opposite control rods. All such additional control nozzles will be disposed on one side of the emitter jet and the associated control rods will be disposed on the opposite side of the jet, so that control flow thorugh one control nozzle will not interfere with flow through any other nozzle, whereby any or all control flows will produce a deflection of the jet away from the receiver entrance.

Other embodiments and modifications, in addition to those discussed above, are intended to be included within the scope of the present invention. For example, a rectifier may be provided by replacing the receiver 14 of FIGS. 3 and 4 by one with a single passageway as in FIG. 5. In operation, the difference in flow to the two control nozzles will result in a proportional reduction in the emitter flow received by the receiver.

The present invention may be adapted to provide other known logic functions and may also be used in three dimensional fluidic devices wherein additional receivers, control nozzles and control members, as necessary, would be provided.

The present invention will be suitable in a variety of applications, and particularly for applications involving liquids wherein control of liquid flow is required.

What is claimed is:

1. A liquid fluid operated control device comprising:

a. an emitter nozzle for coupling to a liquid supply source and operative to issue a free liquid emitter jet having a Weber number of from 8 to 70;

b. control means comprising a control nozzle disposed such that one end thereof terminates within the emitter jet, said nozzle being disposed a distance of less than five emitter jet diameters downstream from the emitter nozzle, said nozzle being operative to issue a control jet for deflecting the emitter jet; and c. receiver means spaced downstream from the emitter for receiving the emitter jet.

2. The apparatus of claim 1 wherein the receiver means comprises an orifice plate disposed substantially perpendicular to the emitter jet, and has a receiver passageway extending downstream therefrom.

3. The apparatus of claim 2 wherein the diameter of the orifice is equal to or less than the diameter of the emitter nozzle.

4. The apparatus of claim 2 wherein the orifice is elongated and two receiver passageways extend downstream therefrom.

5. The apparatus of claim 1 wherein the receiver comprises a receiver passageway having an impedance to flow sufficient to exclude the reception of gas.

6. The apparatus of claim 1 wherein the control means further comprises a control member disposed such that one end thereof terminates within the emitter jet substantially symmetrically opposite to the control nozzle.

7. The apparatus of claim 6 wherein said control member comprises a second control nozzle.

8. The apparatus of claim 6 wherein said control member comprises a solid member having an outer wetting surface geometrically similar to the opposing control nozzle.

9. The apparatus of claim 6 comprising two parallel control nozzles and two opposing parallel control members.

10. The apparatus of claim 1 wherein the control nozzle has a substantially cylindrical outer wetting surface.

11. The apparatus of claim 10 wherein the control nozzle has a free wetting length of at least two control nozzle diameters.

12. The apparatus of claim 1 wherein the length of the emitter nozzle is at least five nozzle diameters.

13. The apparatus of claim 1 wherein the end of the control nozzle terminates at a distance of from 0.1 to 0.2 times the emitter jet diameter, from the emitter jet centerline.

14. The apparatus of claim 1 wherein the receiver means is disposed from five to 20 emitter nozzle diameters downstream from the emitter.

* * * * *